US005967808A

United States Patent [19]

Kubota

[11] Patent Number: 5,967,808

[45] Date of Patent: Oct. 19, 1999

[54] ELECTRICAL JUNCTION BOX CONNECTING STRUCTURE AND CONNECTING METHOD THEREOF

[75] Inventor: Mitsuji Kubota, Shizuoka, Japan

[73] Assignee: Yazaki Corporation, Tokyo, Japan

[21] Appl. No.: 08/904,319

[22] Filed: Jul. 31, 1997

[30] Foreign Application Priority Data

Jan. 24, 1996 [JP] Japan ..... 9-011456
Aug. 5, 1996 [JP] Japan ..... 8-206137

[51] Int. Cl.[6] ..... H01R 13/629

[52] U.S. Cl. ..... 439/157; 439/310

[58] Field of Search ..... 439/157, 310

[56] References Cited

U.S. PATENT DOCUMENTS 4,883,429 11/1989 Suzuki et al. ..... 439/310
5,252,089 10/1993 Hatagishi et al. ..... 439/310

FOREIGN PATENT DOCUMENTS 62-132619 8/1987 Japan .
3-84566 8/1991 Japan .
3-100378 10/1991 Japan .
6-49064 12/1994 Japan .

*Primary Examiner*—Neil Abrams
*Attorney, Agent, or Firm*—Armstrong, Westerman, Hattori, McLeland & Naughton

[57] ABSTRACT

An electrical junction box main body has a first connector, and a junction box receiving case for receiving the junction box main body has a slanting cam groove. A connector block for receiving a second connector engaged with the first connector has a driving pin slidingly engaged with the cam groove. Insertion of the junction box main body into the junction box receiving case causes the connector block to move toward the junction box main body by the driving pin guided by the cam groove. In another embodiment, a junction box main body has a first driving pin and a first group of connectors; a connector housing includes a second group of connectors engaged with the first group of connectors and is provided with a second driving pin; and a junction box receiving case or bracket has a first cam groove associated with the first driving pin, a second cam groove associated with the second driving pin, and clamping means for clamping the junction box main body to the junction box receiving case or bracket, use of the clamping means drawing the junction box main body towards a wall of the case and causing connectors to be drawn towards connectors.

11 Claims, 13 Drawing Sheets

ELECTRICAL JUNCTION BOX CONNECTING STRUCTURE AND CONNECTING METHOD THEREOF

FIELD OF THE INVENTION

The present invention relates to an electrical junction box connecting structure and a connecting method thereof, in which connectors of the electrical junction box can be coupled by making use of a mounting force for attaching an instrument panel of a motor vehicle to the vehicle body or by using a clamping force for bolting the electrical junction box on a bracket of the vehicle.

BACKGROUND OF THE INVENTION

FIG. 16 shows a known electrical junction box connecting structure disclosed in Japanese Utility Model No. H.6-49064.

This structure has a junction box main body 41 receiving upwardly and locking a plurality of female connectors 42. Further, a plurality of male connectors 43 corresponding to the female connectors 42 are disposed in a box housing 44 that is provisionally received in the junction box main body 41 downwardly. Then, screwing a bolt 45 into nut 46 secured to the junction box main body 41 engages the male connectors 43 with the female connectors 42. The female connectors 42 and the male connectors 43 have been connected respectively to wiring harnesses 47 and 48.

The junction box main body 41, the female connectors 42, the male connectors 43, and the box housing 44 constitute an electrical junction box 49. This electrical junction box 49 is mounted, for example, in an instrument panel for a motor vehicle. Meanwhile, when the male connectors 43 are few in number, they are coupled to the female connectors 42 by hand without a bolt.

However, there is no space in the instrument panel for the engagement work by hand of the known structure, restricting the mounting position of the electrical junction box 49. This is a drawback in the structure. Moreover, in connection of the wiring harnesses 47 and 48 by way of the junction box main body 41 in the instrument panel, the connection must be carried out with the instrument panel having been provisionally assembled, or must be carried out after the wiring harnesses 47 and 48 have been spread out from their provisionally assembled state in the instrument panel. This complicated, fatiguing work or a connector connection work carried out with a blind or abnormal posture working condition tends to cause an incorrect connection of the connectors.

SUMMARY OF THE INVENTION

In view of the drawback, an object of the present invention is to provide an electrical junction box connecting means, which allows an easy and sure connector connection for the electrical junction box even in a narrow space that is difficult of access by hand such as in an instrument panel.

For achieving the object, in a first configuration of the present invention, a connecting structure of an electrical junction box comprises:

a junction box main body having a first connector, a junction box receiving case for receiving the junction box main body, the junction box receiving case having a slanting cam groove, and a connector block for receiving a second connector engaged with the first connector, the connector block having a driving pin slidingly engaged with the cam groove, wherein insertion of the junction box main body into the junction box receiving case causes the connector block to move toward the junction box main body by the driving-pin-guided by the cam groove.

The junction box receiving case may be mounted in a panel attached to a vehicle body.

The junction box main body may be formed with an abutment wall to abut against the connector block, and insertion of the junction box main body into the junction box receiving case causes the abutment wall to push the connector block so that the connector block can move toward the junction box main body along the cam groove.

The junction box receiving case may have a guide channel oriented in the panel mounting direction, and the junction box main body having been secured to the vehicle body can be slidingly engaged with the guide channel.

When the abutment wall abuts against the connector block, the first connector of the junction box main body can be opposed to the second connector of the connector block.

Further, a first electrical junction box connecting method of the connecting structure as described in the first configuration of the invention comprises the step of:

provisionally setting the driving pin, fitted on the connector block, at an entry of the cam groove;

securing the junction box main body to the vehicle body; and attaching the panel to the vehicle body, which allowing the junction box main body to advance into the guide channel so that the abutment wall abuts against the connector block to move the connector block along the cam groove toward the junction box main body, enabling complete engagement of the first and second connectors.

Moreover, in a second configuration of the present invention, a connecting structure of an electrical junction box comprises:

a connecting junction box main body having a first driving pin and a first group of connectors, a connector housing including a second group of connectors engaged with the first group of connectors, the connector housing being provided with a second driving pin, and a junction box receiving case having a first cam groove associated with the first driving pin, a second cam groove associated with the second driving pin, and clamping means for clamping the junction box main body to the junction box receiving case, wherein clamping by the clamping means allows the first driving pin to move along the first cam groove, securing the junction box main body to the junction box receiving case, and, at the same time, allows the second driving pin to move along the second cam groove so that the second group of connectors can engage with the first group of connectors.

The clamping means may include a bolt passing through the junction box main body and a nut secured to the junction box receiving case.

The junction box main body may have an inclined wall through which the bolt can pass; the second cam groove inclines in the opposite direction to the inclined wall; the first cam groove extends in the same direction as the second cam groove; and a spacer is disposed between the head of the bolt and the inclined wall.

The first cam groove and the second cam groove may have respectively a slope, both the slopes being inclined in the same direction, and the slope of the first cam groove has a height equal to a space distance between a bottom surface of the junction box receiving case and a bottom surface of the junction box main body.

Further, a second electrical junction box connecting method of the connecting structure as described in the first configuration of the invention comprises the step of:

pushing the junction box main body in a direction perpendicular to the inclined wall by tightening the bolt, which causing the junction box main body to move in its longitudinal direction so that the second group of connectors in the housing can move along the second cam groove to engage with the first group of connectors and, at the same time, the junction box main body can move in its vertical direction to abut against the bottom wall of the junction box receiving case.

Operation of the above-mentioned configurations and methods will be discussed hereinafter.

In the first configuration and method of the invention, attaching the panel to the vehicle body advances simultaneously the junction box main body into the junction box receiving case along the guide channel. The connector block is provisionally set in the junction box receiving case, in which the driving pin is located at the entrance of the cam groove. Insertion of the junction box main body makes the abutment wall of the junction box main body abut a forward end of the connector block, pushing the connector block in the opposite direction to the panel mounting. Thereby, the driving pin moves along the cam groove, allowing the connector block to come close to the junction box main body. Thus, the connector of the connector block engages with the connector of the junction box main body.

In the second configuration and method of the invention, tightening the bolt makes the junction box main body to be pushed in the perpendicular direction to the inclined wall so that the junction box main body and the second connector move together along the first cam groove in their longitudinal direction. At the same time, the second the driving pin of the second connector moves slantingly along the second cam groove, and the second connector moves vertically toward the first connector. Thus, both the connectors engage together. Further, the junction box main body moves vertically along the slope of the first cam groove, causing the bottom wall of the junction box main body to abut against the bottom wall of the junction box receiving case, allowing the junction box main body to be firmly secured to the receiving case.

As stated above, in the first configuration or the first method of the invention, mounting of the panel can achieve the mutual connection of the connectors. This allows a simple, sure connector connection of the wiring harnesses even in a narrow space, such as in an instrument panel, for hand work. Accordingly, the electrical junction box can be positioned more free, achieving an improved working condition in connection of the wiring harnesses.

Further, in the second configuration or the second method of the invention, securing the junction box main body to the junction box receiving case with the bolt accomplishes simultaneously coupling of the connectors, reducing man hour for coupling of the connectors and improving the work condition. In addition, locating the securing bolt apart from the connector engagement section enables a sure connection of the connectors even in a space that is difficult of access by hand.

DETAILED DESCRIPTION OF PREFERRED EMBODIMENTS

Referring to the accompanying drawings, preferred embodiments of the invention will be discussed hereinafter.

Figure 1:
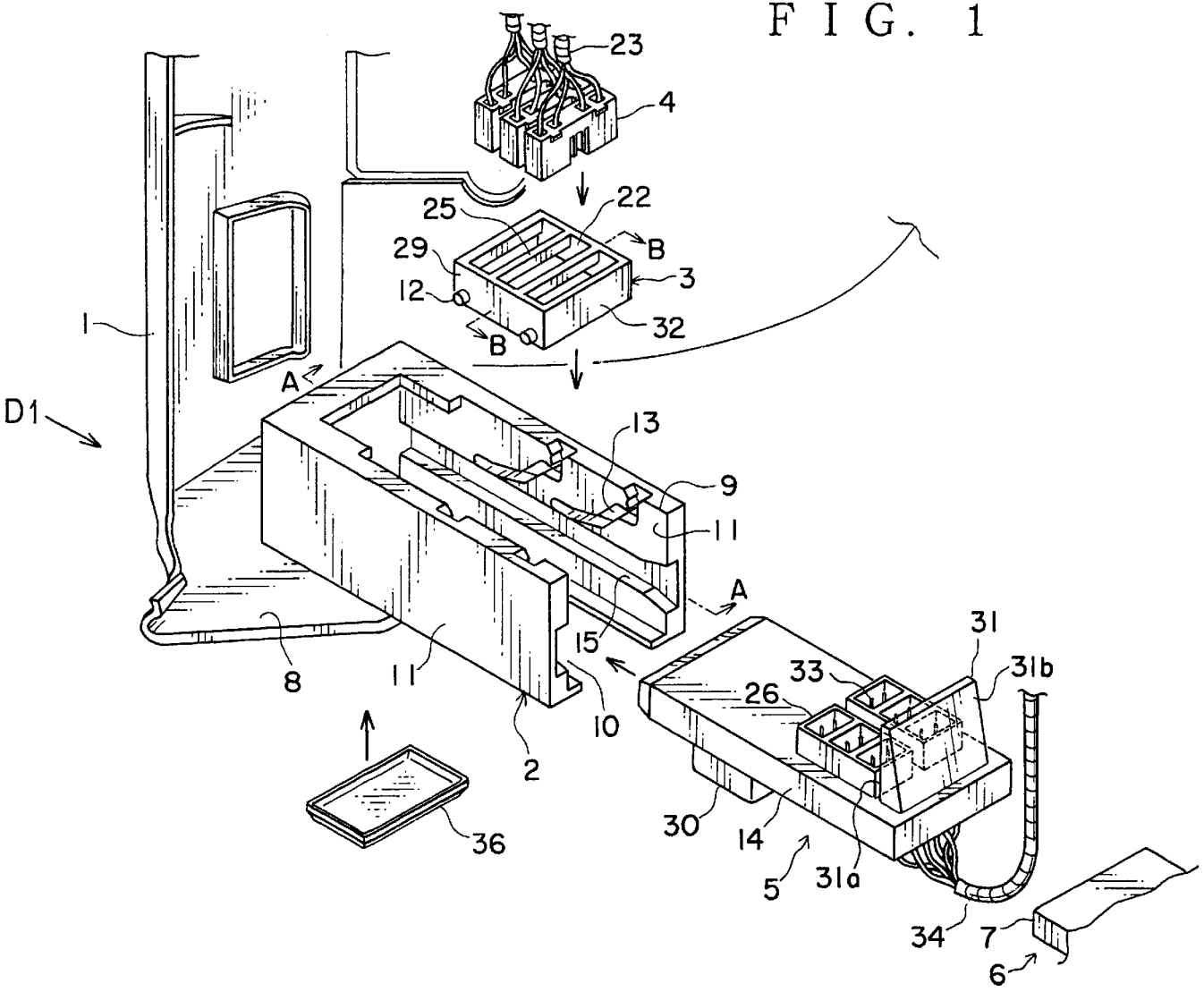
FIG. 1 is an exploded perspective view showing a first embodiment of an electrical junction box connecting structure according to the present invention.

FIG. 1 is an exploded perspective view of a first embodiment of an electrical junction box connecting structure according to the invention. FIGS. 2 to 10 are views showing operational steps thereof.

The connecting structure, as shown in FIG. 1, includes: a junction box receiving case 2 provided within a side portion of an instrument panel 1 mounted in a motor vehicle, a rectangular connector block 3 provisionally disposed downwardly in the junction box receiving case 2, a plurality of male connectors 4 received and locked in the connector block 3, a junction box main body (J/B) 5 slidingly inserted from the front into the junction box receiving case 2, and a junction box securing part 7 provided in the vehicle body 6 for securing the junction box main body 5.

The instrument panel 1, advances from the cabin side into the engine side (the vehicle body side) to be secured thereto. The junction box receiving case 2 , made of a synthetic resin, is engaged firmly to a bottom wall 8 of the instrument panel 1. The junction box receiving case 2 has an opening 9 receiving the connector block 3 in an upper portion thereof, and an opening 10 receiving the junction box main body 5 into a forward portion thereof.

Further, the junction box receiving case 2, inside of each side wall 11 thereof and adjacent to the upper opening 9, has a pair of fore and aft, inclined, cam grooves (guide grooves) 13 for downwardly slidingly guiding a driving pin 12 of a connector block 32. Additionally, a pair of horizontal guide channels 15 for slidingly receiving a housing 14 of the junction box main body 5 are provided to extend from the forward opening 10 to an aft end of the junction box receiving case 2.

Figure 2:
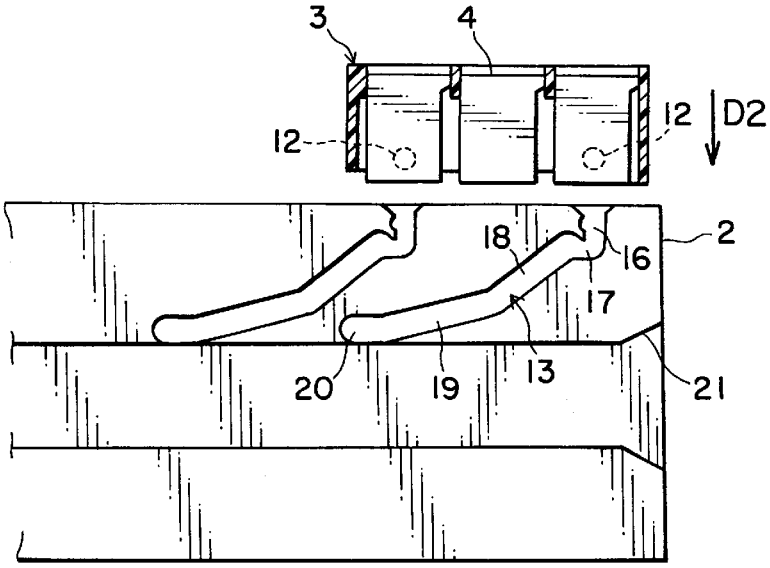
FIG. 2 is a sectional view taken on A—A in FIG. 1 generally, which shows a state that a connector block is going to be set on a junction box receiving case.

The cam groove 13, as shown in FIG. 2, includes a vertical entrance 16, a short horizontal part (a provisional setting portion) 17 adjacent to the entrance 16, a first steep slope 18 adjacent to the horizontal part 17, a second gentle slope 19 adjacent to the first slope 18, and a horizontal lock portion 20 provided in the groove end. Further, the horizontal guide channel 15 has a tapered, enlarged insertion entrance 21.

Figure 4:
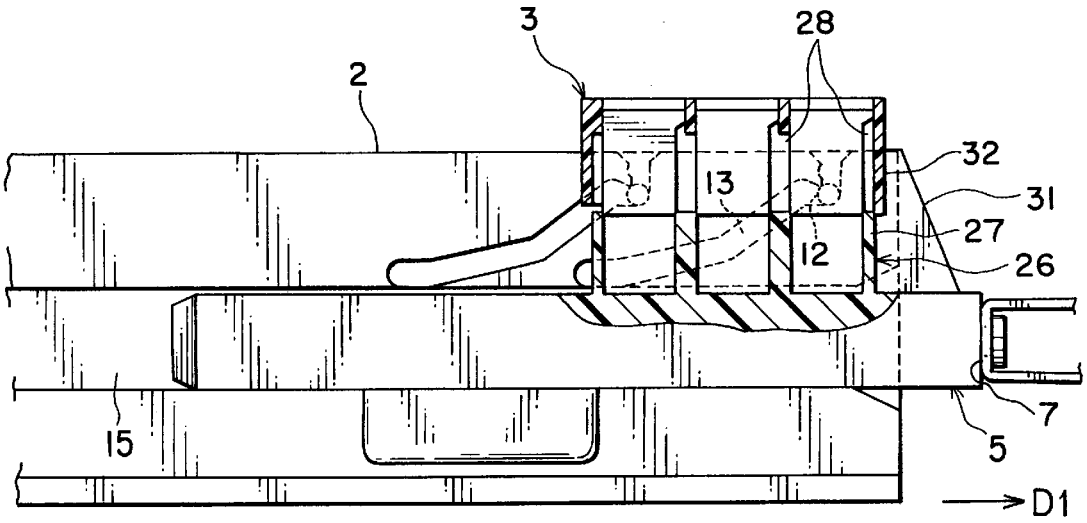
FIG. 4 is a sectional view taken on A—A in FIG. 1 generally, which shows a state that the junction box main body has been inserted into the junction box receiving case.
Figure 5:
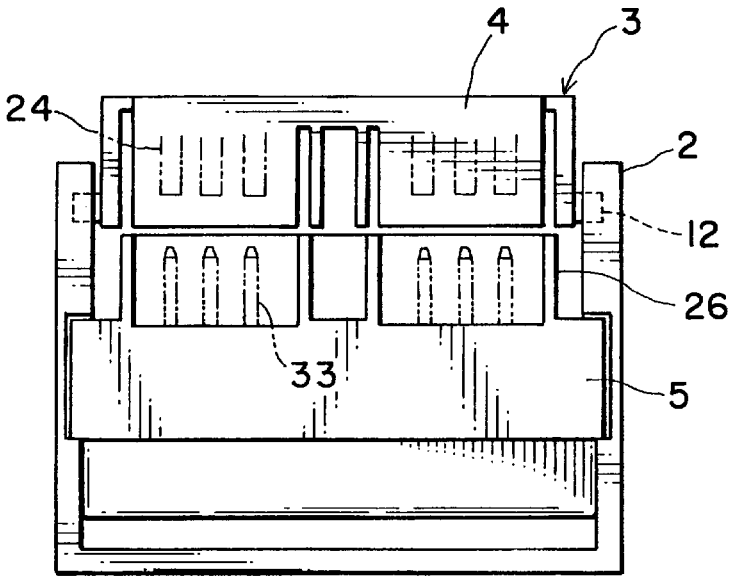
FIG. 5 is a sectional view taken on B—B in FIG. 1, which shows a state that the junction box main body has been inserted into the junction box receiving case.

In FIG. 1, the connector block 3, which is made of a synthetic resin, has a plurality of through-chambers 22 for inserting male connectors 4 therethrough. The male connectors 4 are fixed in the through-chambers 22 by securing means (not shown) such as lock protrusions. The male connectors 4 accommodate a plurality of female terminals 24 (FIG. 5) connected to the wiring harness 23. Between a frame wall 25 constituting the through-chambers 22 and the male connector 4, as shown in FIGS. 4 and 5, there are provided a plurality of recesses 28 for inserting relative housing walls 27 of the female connector 26 provided in the junction box main body 5. From each outer surface 29 of the connector block 3, as shown in FIG. 1, there are extending a pair of fore and aft driving pins 12.

In FIG. 1, the junction box main body 5 has the housing 14 made of a synthetic resin, the female connector 26, and, for example a fuse block 30 projectingly formed in a bottom surface of the housing 14. The housing 14 has, at an upper surface thereof, an abutment wall 31 abutted against the connector block 3, the abutment wall 31 being taller than the female connector 26 and positioned at a rearward end of the housing 14 in the insertion direction of the horizontal guide channel 15. In addition, the abutment wall 31 is located in the rear of the female connector 26 with a little distance therebetween.

The abutment wall 31 includes both a vertical face 31*a* for abutting against a forward end face 32 of the connector block 3 and a rearward inclined face 31*b*. When the male connector 4 of the connector block 3 has vertically opposed to the female connector 26 of the junction box main body 5, the vertical face 31*a* of the abutment wall 31 can make contact with the forward end face 32 of the connector block 3. The female connector 26 accommodates male terminals 33 connected to a wiring harness 34.

Figure 3:
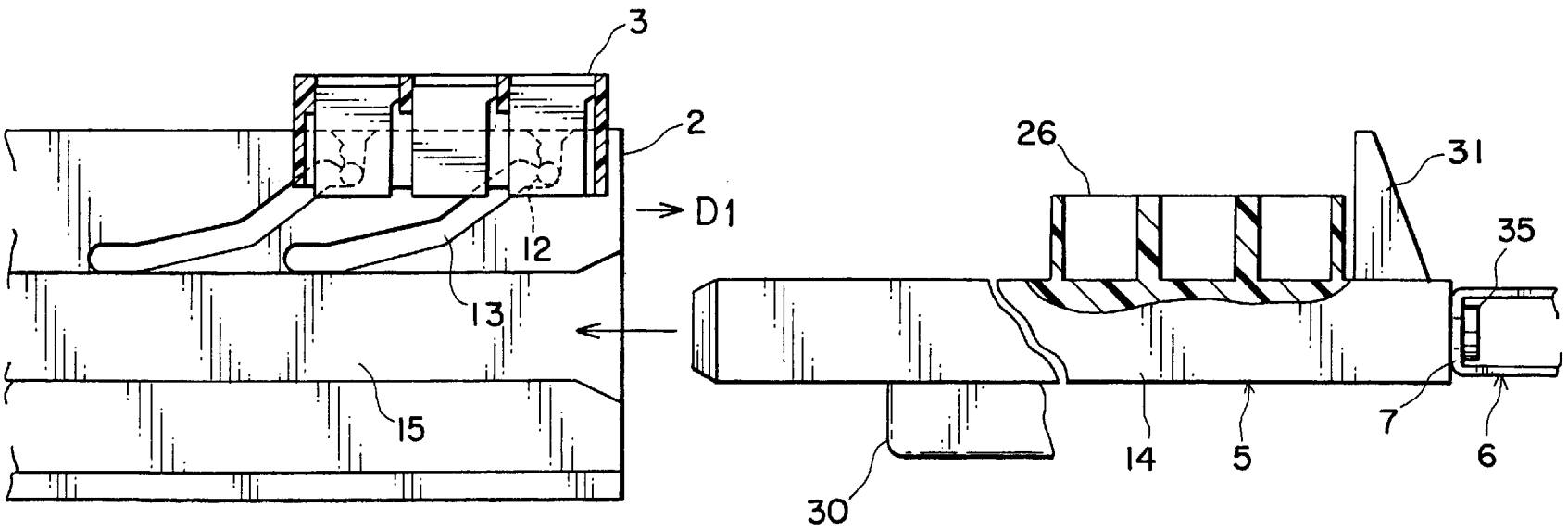
FIG. 3 is a sectional view taken on A—A in FIG. 1 generally, which shows a state that a junction box main body begins to advance into the junction box receiving case.

The junction box main body 5, at a rear end of the housing 14, is preliminarily secured to a support member 7 provided on the vehicle body 6, as shown in FIG. 3, with a securing means 35 such as bolting. As shown in FIG. 1, the fuse block 30 can be covered by a protecting cover 36.

Operational of the connecting structure and the connecting method of the electrical junction box will be discussed hereinafter.

First, as shown in FIGS. 2 and 3, on the junction box receiving case 2 disposed in the side of the instrument panel 1 there is preliminarily located the connector block 3 in the direction of an arrow head D2. The connector block 3 includes a plurality of the male connectors 4 preliminarily engaged and locked therein. The connector block 3 can be preliminarily disposed by inserting the driving pin 12 into the entrance 16 of the cam groove 13 in the junction box receiving case 2 to be positioned in the short horizontal portion 17. Meanwhile, as described above, the junction box main body 5 has been secured to the vehicle body 6.

Next, the instrument panel 1 advances in the direction of an arrow head D1, as shown in FIG. 3, to be fixed in the side of the vehicle body 6. Thereby, as shown in FIGS. 4 and 5, the junction box main body 5 can enter into the junction box receiving case 2 along the guide channel 15.

Figure 6:
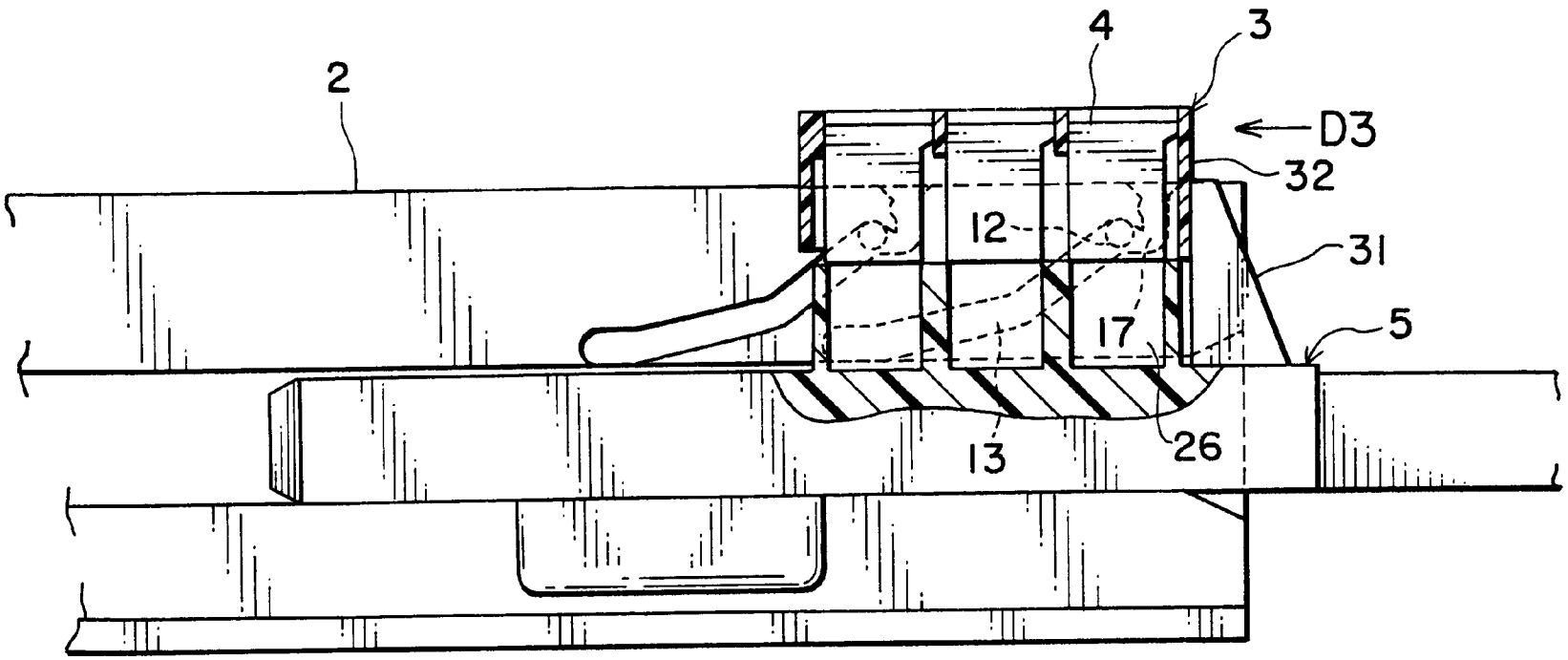
FIG. 6 is a sectional view taken on A—A in FIG. 1 generally, which shows a state that an abutment wall is pushing horizontally the connector block.

With the insertion of the junction box main body 2, the abutment wall 31 of the junction box main body 2 abuts against the forward end face 32 of the connector block 3, pushing the connector block 3 in the opposite direction to the instrument panel (shown by an arrow head D3 in FIG. 6). More definitely, pushing the instrument panel 1 in its mounting direction (shown by an arrow head D3) makes the forward end face 32 of the connector block 3 abut against the abutment wall 31 of the junction box main body 5. When the abutment wall 31 has abutted against the connector block 3, the male connector 4 in the connector block 3 vertically opposes to the female connector 26 of the junction box main body.

As the abutment wall 31 pushes the connector block 3, as shown in FIGS. 6 to 10, the driving pin 12 of the connector block 3 moves slantingly downwardly along of the cam groove 13 of the junction box receiving case 2. At the same time, the connector block 3 moves downwardly unitedly with the driving pin 12, that is, in the direction shown by an arrow head D4. Thus, as shown in FIGS. 7 to 10, the male connector 4 in the connector block 3 can engage gradually with the female connector 26 of the junction box main body 5.

That is, the force for attaching the instrument panel 1 can make the connector block 3 move slantingly downwardly along the cam groove 13, allowing the female connector 26 of the junction box main body 5 to move unitedly with the connector block 3 to engage with the male connector 4 of the connector block 3.

In FIG. 6, the driving pin 12 is moving along the short horizontal portion 17 of the cam groove 13.

Figure 8:
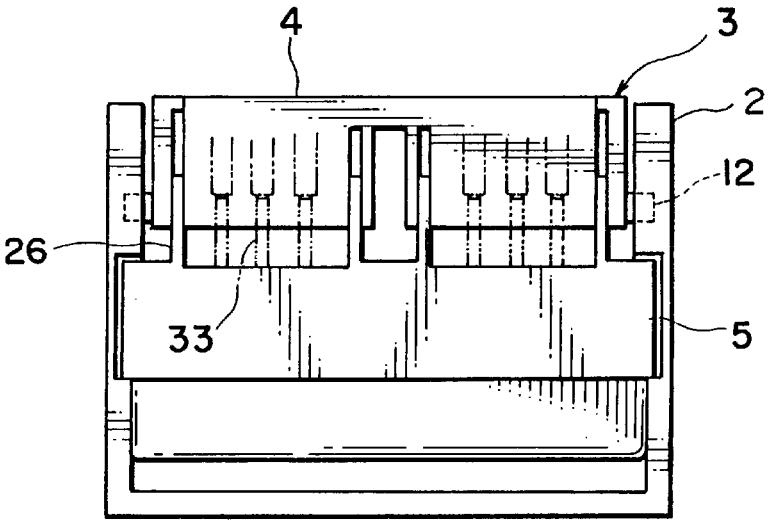
FIG. 8 is a sectional view taken on B—B in FIG. 1, which shows a state that a pair of connectors have began to engage with each other.
Figure 7:
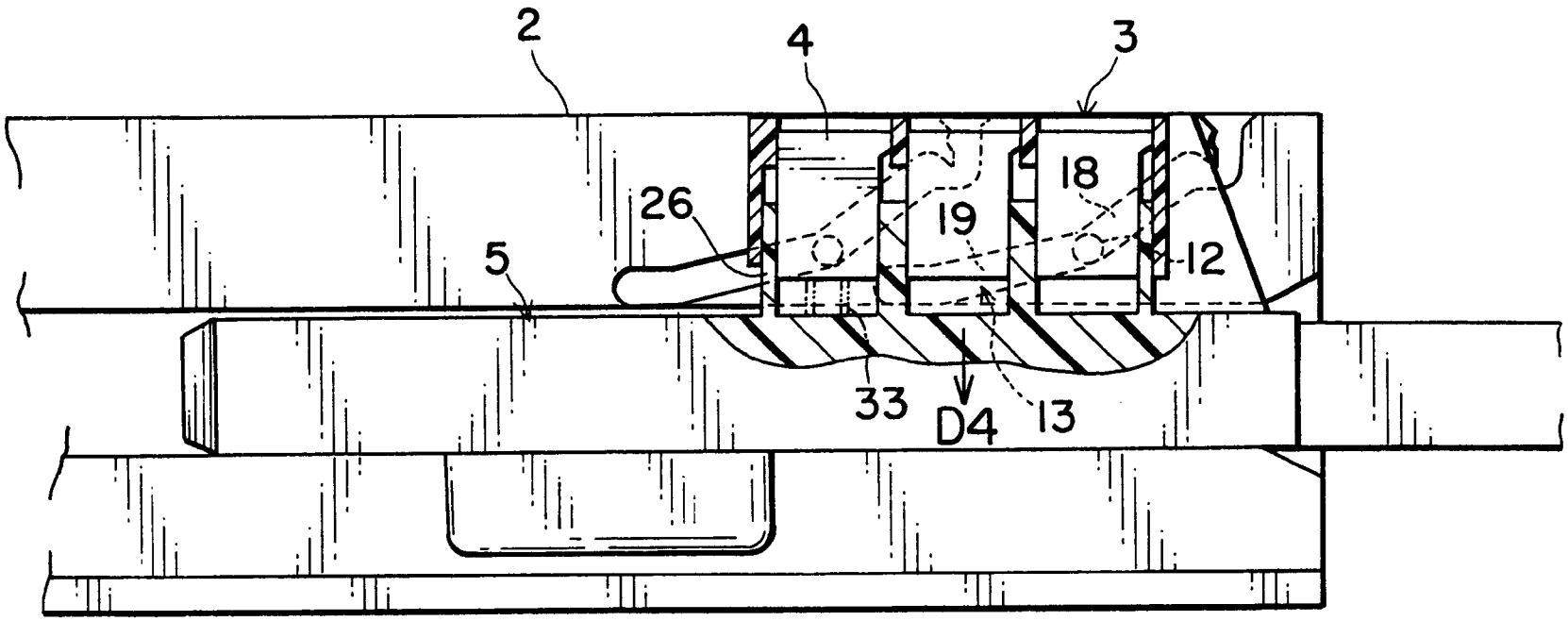
FIG. 7 is a sectional view taken on A—A in FIG. 1 generally, which shows a state that a pair of connectors has began to engage with each other.

In FIGS. 7 and 8, the driving pin 12 has slid to reach approximately in the middle of the cam groove 13, and the male connector 4 begins to engage with the female connector 26. Denoted 33 are male terminals. Before engagement of the connectors 4 and 26, the driving pin 12 moves within the first steep slope 18, and, during the engagement, the pin moves within the second slant slope 19. Thereby, a relatively small force acted on the instrument panel 1 can provide a relatively large force for engaging the connectors.

Figure 9:
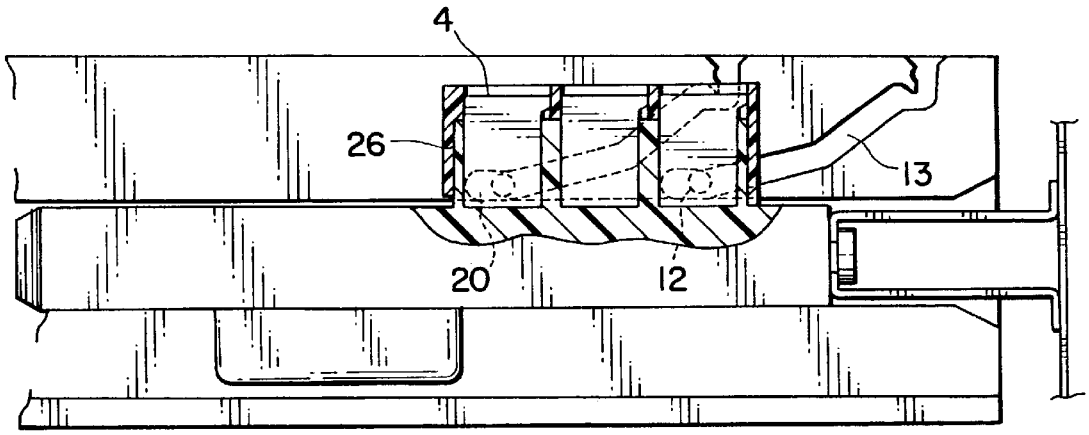
FIG. 9 is a sectional view taken on A—A in FIG. 1 generally, which shows the state that the pair of connectors have engaged with each other.
Figure 10:
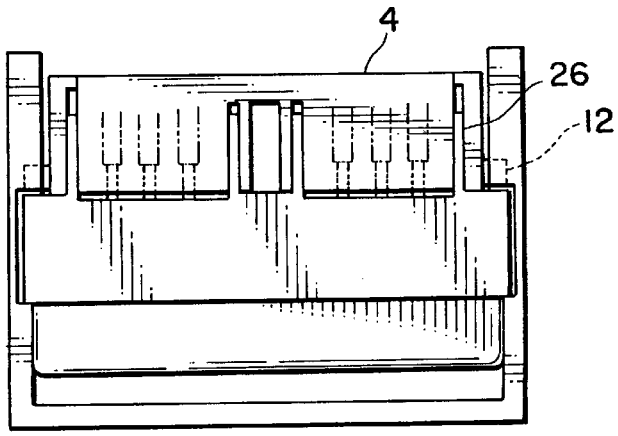
FIG. 10 is a sectional view taken on B—B in FIG. 1, which shows the state that the pair of connectors have engaged with each other.

In FIGS. 9 and 10, the connectors 4 and 26 have engaged with one another, and, after that, the instrument panel 1 will be finally secured so that the driving pin 12 engages with the horizontal lock portion 20 of the cam groove 13.

Meanwhile, in disengagement of the connectors 4 and 26, drawing out the junction box main body 5 from the junction box receiving case 2 moves upward the driving pin 12 of the connector block 3 along the cam groove 13. Thereby, the connector block 3 can remove from the junction box main body 5, releasing engagement between the male and female connectors 4, 26.

FIGS. 11 to 15 show a second embodiment of an electrical junction box connecting structure according to the present invention.

In this structure, a junction box (J/B) main body 51 is secured to a bracket (a junction box receiving case) 52 with a bolt 53. Such act of securing causes a group of female connectors 54 of the junction box main body 51 to become engaged with an opposing group of male connectors 55.

Figure 11:
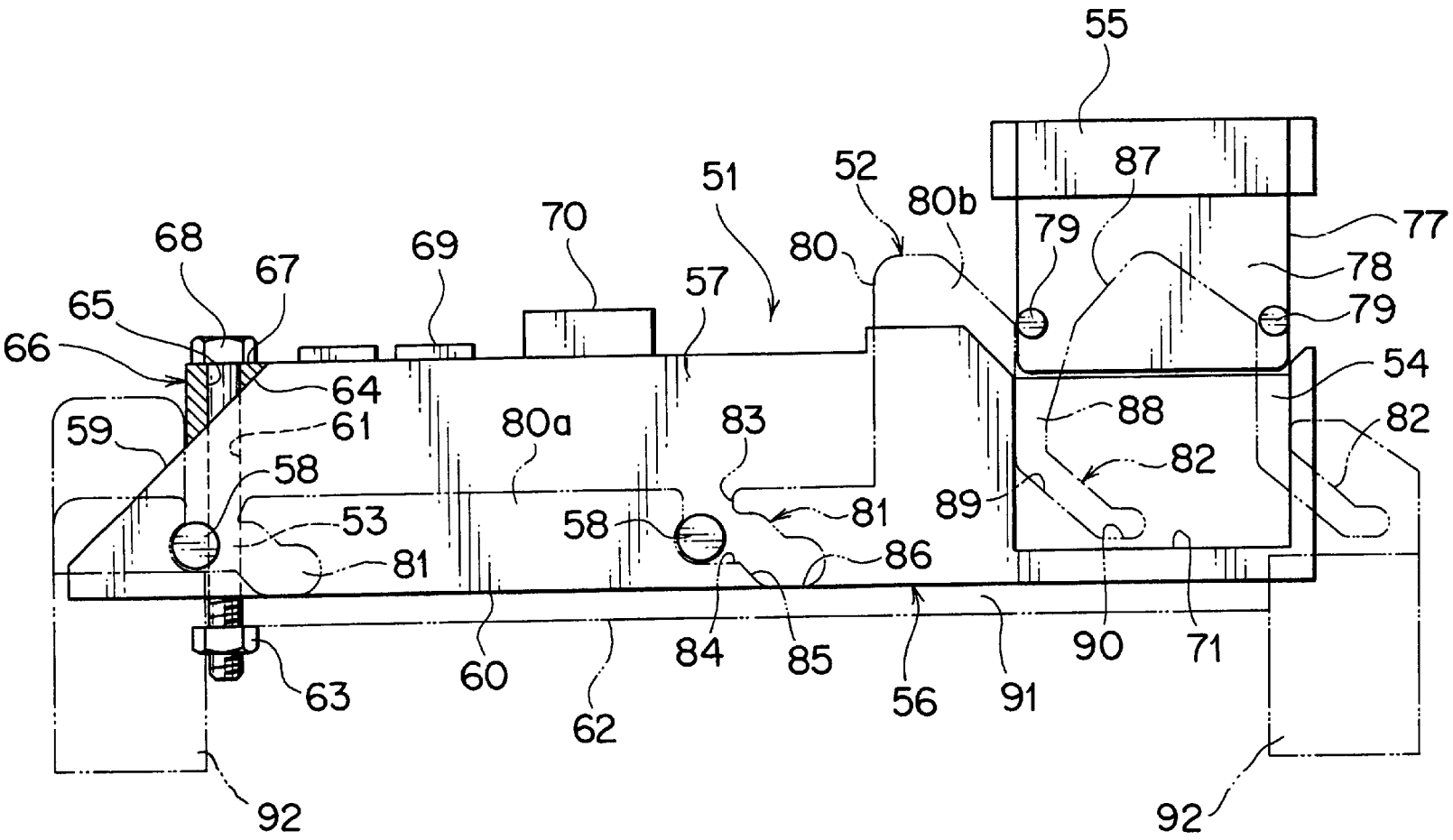
FIG. 11 is a side view showing a second embodiment of an electrical junction box connecting structure according to the present invention.
Figure 12:
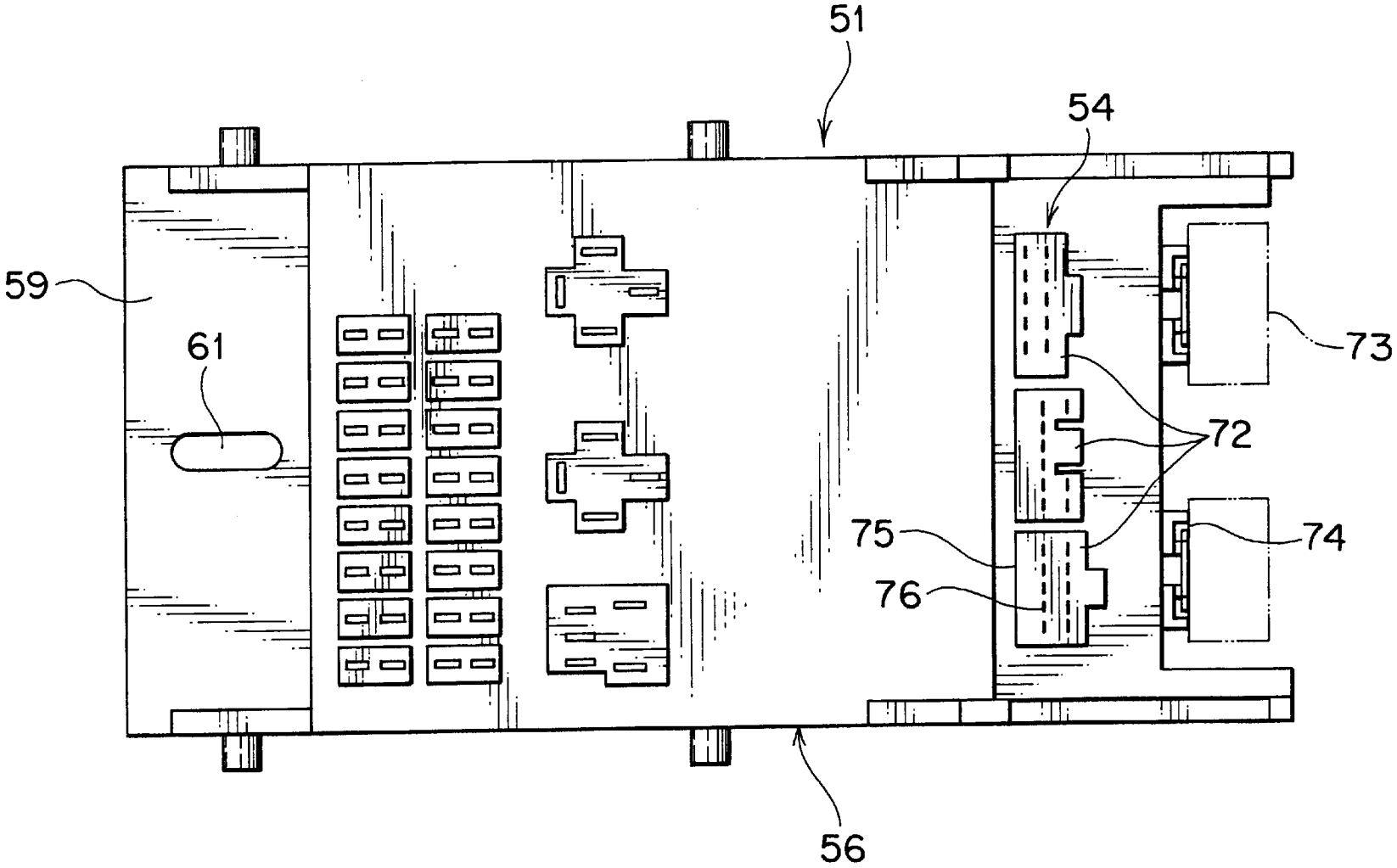
FIG. 12 is a top view showing a junction box main body of the second embodiment.
Figure 13:
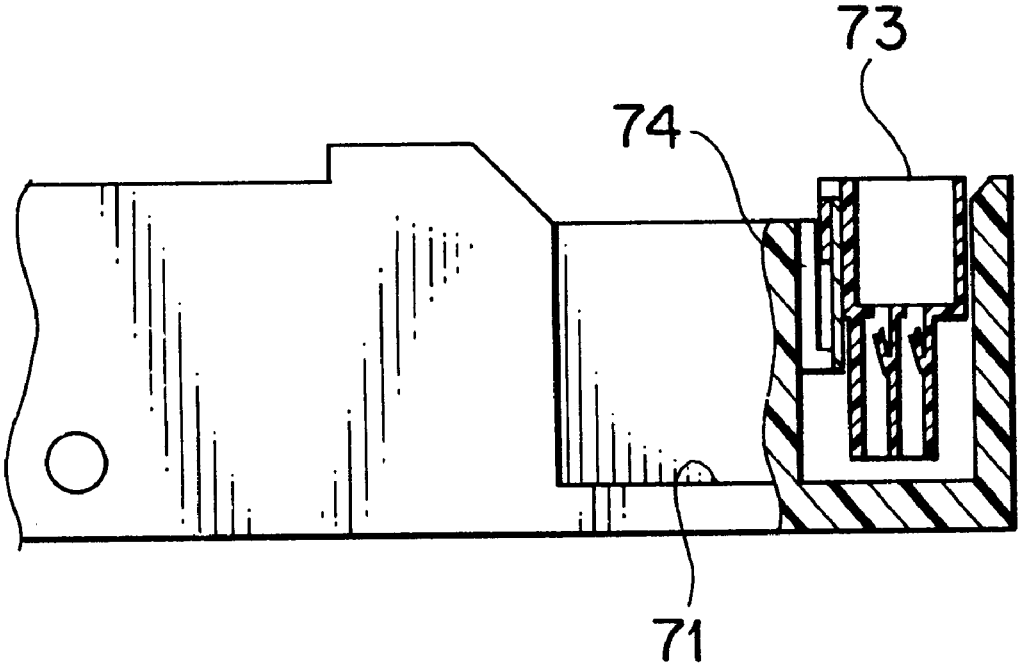
FIG. 13 is a general side view showing the junction box main body.

Referring to FIGS. 11 to 13, the junction box main body 51 has a housing 56 made of a synthetic resin, on each side wall 57 of which there are projectingly formed with a pair of fore and aft driving pins (first driving pins) 58, 58, the driving pin 58 is a short cylindrical rod and is arranged in a lower portion of each side wall 57.

The housing 56, at a rear end thereof, has a tapered inclined wall 59. From the inclined wall 59 to a bottom wall 60 of the housing 56, an elongated through-hole 61 (FIG. 12) for passing a bolt 53. The bolt 53 inserted through the elongated hole 61 is screwed into a nut 63 secured to a bottom wall 62 of the bracket 52. The bolt 53 is at an initial tightening stage.

Between the bolt 53 and the inclined wall 59 of the housing 56, is inserted a spacer 66 having a bolt through-hole 65 and an inclined surface 64 with the same angle as the inclined wall 59. The spacer 66 has a top surface 67 with a larger area than the head 68 of the bolt 53. Further, the spacer may be an L-shaped plate without an inclined face. The spacer 66 can stably support vertically the bolt 53.

Additionally, the junction box main body 51 has, on the top surface thereof, a plurality of fuse connection parts 69 and relay connection parts 70. In a forward portion of the junction box main body 51, there are mounted a group of female connectors 54. The female connector housing 54 having a plurality of parallel female connectors 72, 73, as shown in FIGS. 12 to 13, is disposed in a recess 71 formed in the housing 56.

The female connector 73 shown in FIG. 13 is downwardly engaged with and secured to a guide rail 74 (see FIG. 12) of the housing 56. Each female connector 72 or 73 has a plurality of male tab terminals 76 in its connector housing 75 made of a synthetic resin.

Referring to FIG. 11, as opposed to the female connector group 54, a male connector group 55 (a not shown plurality of male connectors) is mounted in a rectangular-frame-shaped connector block 77. The connector block 77 can engage with the recess 71 of the housing 56. The connector block 77 has each side wall 78, at a lower portion of which there are projectingly formed two pairs of fore and aft driving pins (second driving pins) 79, 79. Each driving pin 79 has a smaller diameter than the driving pin 58 formed on the junction box main body 51.

The bracket 52 has each side wall 80 rising from the bottom wall 62. Each side wall 80 is formed with a pair of first cam grooves (guide grooves) 81, 81 for the driving pins 58 of the junction box main body 51, and a pair of second cam grooves (guide grooves) 82, 82 for driving the pins 79 of the connector block 77. The second cam grooves extend to the same side as the first cam grooves.

The first cam groove 81 is formed in a rear, lower portion 80*a* of the bracket side wall, and consists of a first horizontal portion 84 adjacent to an entrance 83, a slope 85 extending slantingly downwardly from the first horizontal portion 84, and a second horizontal portion (lock portion) 86 adjacent to the slope 85.

Meanwhile, the second cam groove 82 is formed in a fore, higher portion 80*b* of the bracket side wall, and consists of a deep entrance 88 having a tapered guide 87, a relatively long slope 89 extending in the same way as the first cam groove 81 from the entrance 88, and a short horizontal portion (lock portion) 90 adjacent to the slope 89. Both the slopes 85, 89 of the cam grooves 81, 82 extend approximately perpendicularly to the inclined wall 59 of the junction box main body 51.

Figure 14:
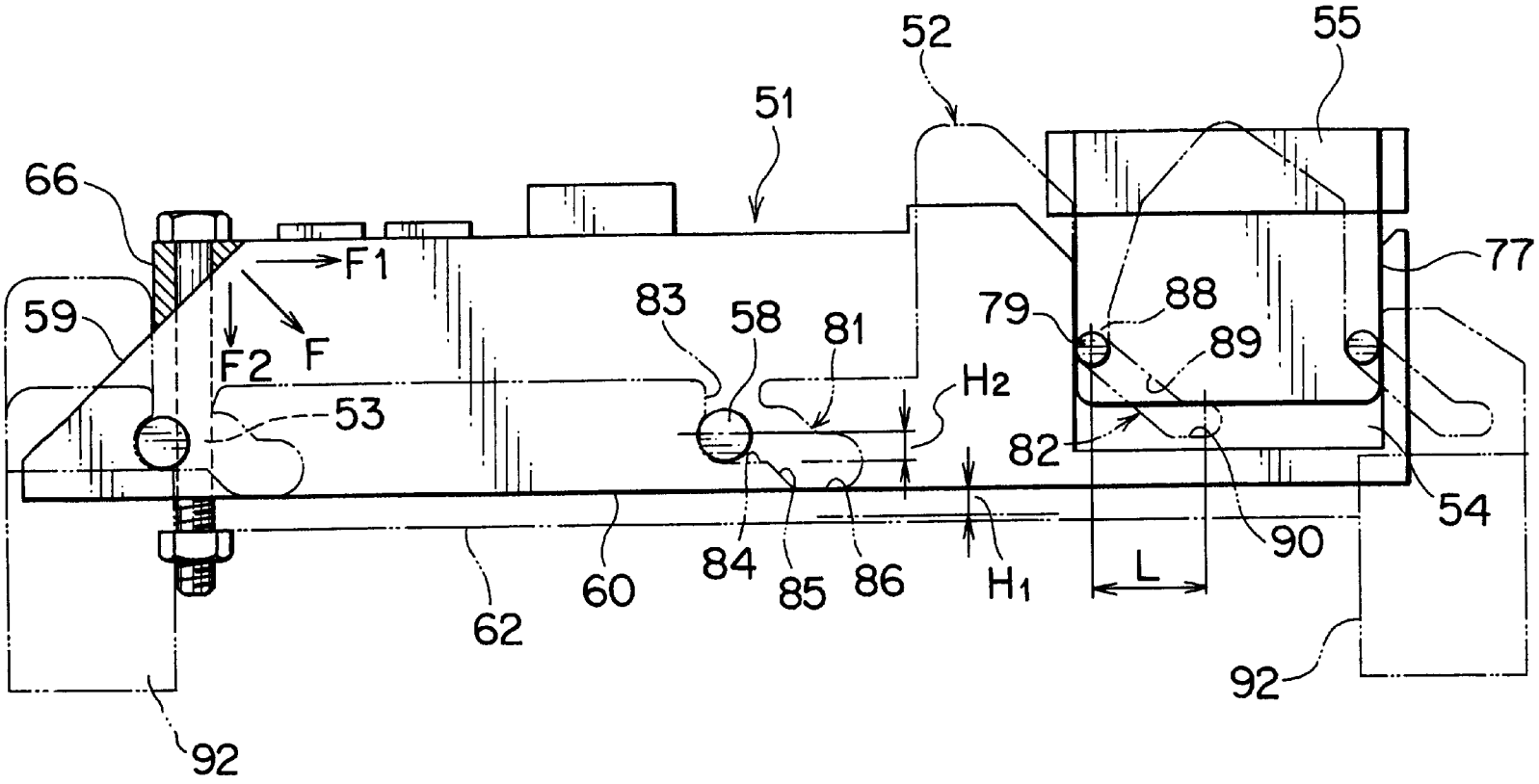
FIG. 14 is a side view of the junction box main body that has preliminarily received a male connector.

The first the cam groove 81 is different from the second the cam groove 82 in height, and the second cam groove 82 is longer than the first cam groove 81. However, the horizontal distances are designed to be equal. That is, as shown in FIG. 14, the horizontal transferring distance L of the driving pin 79 from the entrance 88 to the lock portion 90 is the same as that of the driving pin 58 from the entrance 83 to the lock portion 86. Thus, the male connector group 55 can move horizontally by the same distance as the junction box main body 51.

Referring to FIGS. 11 and 14, at an initial engagement stage of the first cam groove 81 and the first the driving pin 58, there is a gap 91 between the bottom wall 62 of the bracket 52 and the bottom wall 60 of the junction box main body 52. The height H1 of the gap 91 (FIG. 14) is designed to be equal to the height H2 of the slope 85 in the first cam groove 81. The height H2 is, more definitely, the transferring height of the driving pin 58 from the first horizontal portion 84 to the lock portion 86. At fore and aft ends of the bracket 51 stands respectively a box-shaped wall 92 for securing the bracket to the vehicle body.

In the connector connection, as shown in FIG. 14, the driving pin 58 of the junction box main body 51 enters from the entrance 83 of the first cam groove 81 into the first horizontal portion 84. At the same time, the driving pin 79 of the connector block 77 enters from the entrance 88 into the second cam groove 82 to reach the entrance of the slope 89.

Then, tightening the bolt 53 causes the spacer 66 to advance toward the junction box main body 51, as shown by an arrow head F, in a perpendicular direction to the inclined wall 59. This pushing force generates a horizontal component shown by an arrow head F1 and a vertical component shown by an arrow head F2.

Figure 15:
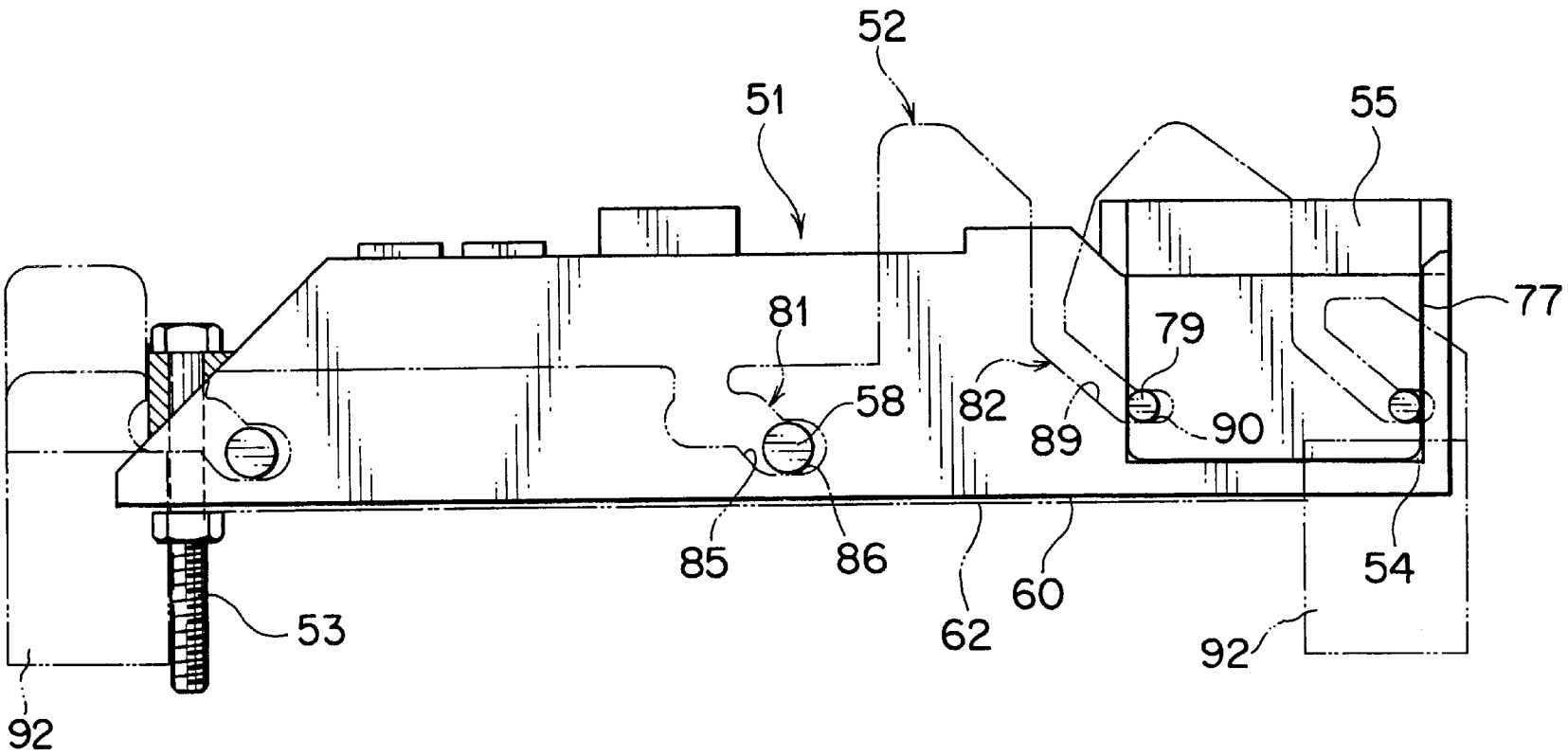
FIG. 15 is a side view showing the state that a securing bolt has completed both securing of the junction box main body and coupling of a pair of connectors simultaneously.
Figure 16:
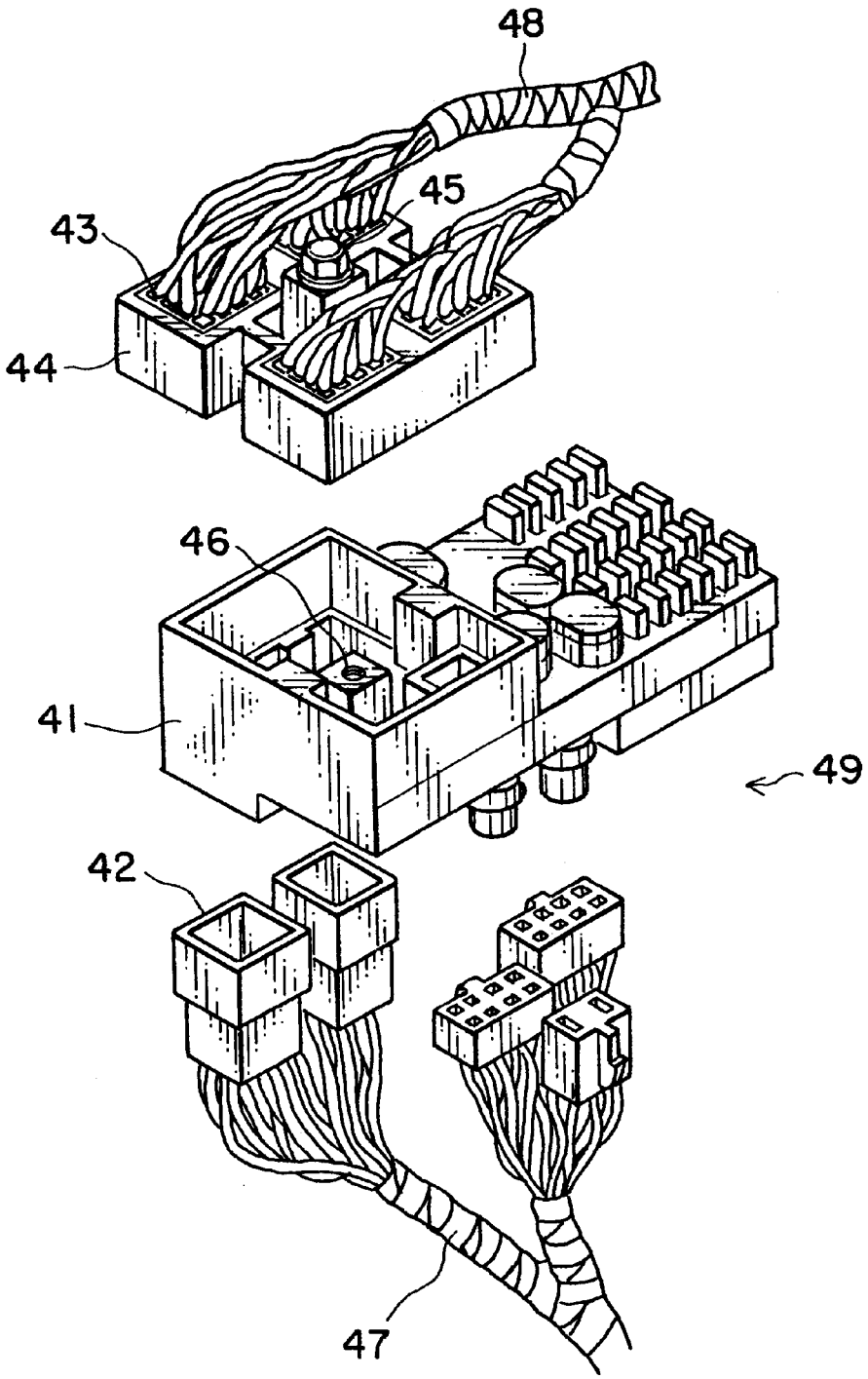
FIG. 16 PRIOR ART
FIG. 16 is an exploded perspective view showing a known electrical junction box connecting structure.

The horizontal component F1 moves the driving pin 58 of the junction box main body 51 along the first horizontal portion 84 of the first guide groove 81. This moves horizontally the junction box main body 51 united with the driving pin 58. Next, the driving pin 58 slides through the slope 85, as shown in FIG. 15, to enter into the second horizontal portion 86. The slanting, downward movement of the driving pin 58 along the slope 85 moves vertically the junction box main body 51 toward the bottom wall 62 of the bracket 52.

The male connector group 55 moves horizontally from its position in FIG. 14 unitedly with the junction box main body 51. At the same time, the driving pin 79 of the connector block 77, as shown in FIG. 15, moves slantingly downwardly along the slope 89 of the second cam groove 82. Thereby, the male connector group 55 moves downwardly toward the female connector group 54 unitedly with the connector block 77, allowing connection of the connector groups. Thus, the plurality of male and female connectors 72, 73 can engage smoothly with each other.

The driving pin 58 of the junction box main body 51 engages with and locks to the second horizontal portion 86 of the first cam groove 81. Thereby, the junction box main body 51 is stably retained by the bracket 52. Further, the driving pin 79 of the connector block 77 engages with and locks to the horizontal portion 90 of the second cam groove 82. At that time, the connector block 77 locks to the female connector group 54. Simultaneously, tightening the bolt 53 makes the bottom wall 60 of the junction box main body 51 abut against the bottom wall 62 of the bracket 52, firmly securing the junction box main body 51 to the bracket 52.

Alternatively, for engaging the connector groups 54, 55, it is only required that the second cam groove 82 has the slope 89. That is, the first cam groove 81 need not the slope 85. The slope 85 of the first cam groove 81 moves vertically the junction box main body 51, causing the bottom wall 60 to abut against the bottom wall 62 of the bracket 52. This enables a stable securing of the junction box main body 51. This structure also enables an aimed connecting method of the electrical junction box.

In this embodiment, tightening of the bolt 53 allows both securing of the junction box main body 51 and engagement of the male and female connector groups 54, 55 simultaneously and reliably.

What is claimed is:

1. An electrical junction box connecting structure comprising:

a junction box main body having a first connector, a junction box receiving case for receiving said junction box main body, said junction box receiving case having a slanting cam groove and a guide channel, and a connector block for receiving a second connector capable of being engaged with the first connector, said connector block having a driving pin slidingly engaged with the cam groove, wherein insertion of said junction box main body into said guide channel of said junction box receiving case causes said connector block to move toward said junction box main body by the driving pin guided by the cam groove.

2. An electrical junction box connecting structure as set forth in claim 1, wherein said junction box receiving case is mounted in a panel attached to a vehicle.

3. An electrical junction box connecting structure as set forth in claim 2, wherein said junction box main body is formed with an abutment wall to abut against said connector block, and insertion of said junction box main body into said junction box receiving case causes said abutment wall to push said connector block so that said connector block can move toward said junction box main body along the cam groove.

4. An electrical junction box connecting structure as set forth in claim 3, wherein said guide channel is oriented in a mounting direction of the panel, and said junction box main body secured to the vehicle can be slidingly engaged with the guide channel.

5. An electrical junction box connecting structure as set forth in claim 4, wherein when said abutment wall abuts against said connector block, the first connector of said junction box main body is opposed to the second connector of said connector block.

6. An electrical junction box connecting method of the connecting structure as set forth in claim 4 comprising the steps of:

provisionally setting the driving pin, fitted on said connector block, at an entry of the cam groove;

securing said junction box main body to the vehicle; and attaching the panel to the vehicle, which allowing said junction box main body to advance into the guide channel so that said abutment wall abuts against said connector block to move said connector block along the cam groove toward said junction box main body, enabling complete engagement of the first and second connectors.

7. An electrical junction box connecting structure comprising:

a junction box main body having a first driving pin and a first group of connectors, a connector housing including a second group of connectors capable of being engaged with the first group of connectors, said connector housing being provided with a second driving pin, and a junction box receiving case having a first cam groove associated with the first driving pin, a second cam groove associated with the second driving pin, and clamping means for clamping said junction box main body to said junction box receiving case, wherein clamping by said clamping means allows the first driving pin to move along the first cam groove, securing said junction box main body to said junction box receiving case, and, at the same time, allows the second driving pin to move along the second cam groove so that the second group of connectors can engage with the first group of connectors.

8. An electrical junction box connecting structure as set forth in claim 7, wherein said clamping means include a bolt passing through said junction box main body and a nut secured to said junction box receiving case.

9. An electrical junction box connecting structure as set forth in claim 8, wherein said junction box main body has an inclined wall through which the bolt can pass; the second cam groove inclines in the opposite direction to said inclined wall; the first cam groove extends in the same direction as the second cam groove; and a spacer is disposed between the head of the bolt and said inclined wall.

10. An electrical junction box connecting structure as set forth in claim 9, wherein the first cam groove and the second cam groove has respectively a slope, both the slopes being inclined in the same direction, and the slope of the first cam groove has a height equal to a space distance between a bottom surface of said junction box receiving case and a bottom surface of said junction box main body.

11. An electrical junction box connecting method of the connecting structure as set forth in claim 10 comprising the step of:

pushing said junction box main body in a direction perpendicular to said inclined wall by tightening the bolt, which causing said junction box main body to move in its longitudinal direction so that the second group of connectors in the connector housing can move along the second cam groove to engage with the first group of connectors and, at the same time, said junction box main body can move in its vertical direction to abut against the bottom wall of said junction box receiving case.

* * * * *